US009334671B2

(12) United States Patent
Kelly

(10) Patent No.: US 9,334,671 B2
(45) Date of Patent: May 10, 2016

(54) CONFIGURABLE ROTARY SECURITY PANEL BARRIER

(71) Applicant: Rory Kelly, Escalon, CA (US)

(72) Inventor: Rory Kelly, Escalon, CA (US)

( * ) Notice: Subject to any disclaimer, the term of this patent is extended or adjusted under 35 U.S.C. 154(b) by 161 days.

(21) Appl. No.: 14/185,585

(22) Filed: Feb. 20, 2014

(65) Prior Publication Data

US 2015/0233140 A1 Aug. 20, 2015

(51) Int. Cl.

*E04H 17/00* (2006.01)
*E04H 17/04* (2006.01)
*E04H 17/24* (2006.01)

(52) U.S. Cl.

CPC ..... *E04H 17/003* (2013.01); *E04H 17/04* (2013.01); *E04H 17/24* (2013.01); *Y10T 29/49826* (2015.01)

(58) Field of Classification Search

CPC ..... E04H 17/00; E04H 17/003; E04H 17/04; E04H 17/063; E04H 17/16; E04H 17/165; E04H 17/166; E04H 17/24
USPC ..... 256/11, 12; 29/428
See application file for complete search history.

(56) References Cited

U.S. PATENT DOCUMENTS

| | | | | | |
|---|---|---|---|---|---|
| 259,654 | A * | 6/1882 | Worthington | E04H 17/003 | 256/12 |
| 321,171 | A * | 6/1885 | Archibald | E04H 17/003 | 256/12 |
| 435,708 | A * | 9/1890 | Poole | E04H 17/003 | 256/12 |
| 504,936 | A * | 9/1893 | Niles | E04H 17/003 | 256/12 |
| 511,700 | A * | 12/1893 | Jacobs | E04H 17/003 | 256/12 |
| 511,701 | A * | 12/1893 | Jacobs | E04H 17/003 | 256/12 |
| 4,270,736 | A * | 6/1981 | Burch | E04H 17/003 | 256/12 |
| 4,348,012 | A | 9/1982 | McLoughlin | | |
| 4,739,970 | A | 4/1988 | Francis | | |
| 5,143,354 | A * | 9/1992 | Nolan | E04H 17/003 | 256/12 |
| 7,243,465 | B2 * | 7/2007 | Donoho | A01M 29/32 | 256/11 |
| 2005/0189529 | A1 * | 9/2005 | Humphreys | E04H 17/003 | 256/12 |
| 2010/0229802 | A1 * | 9/2010 | Bok | E04H 17/003 | 256/12 |

FOREIGN PATENT DOCUMENTS

| | | | | |
|---|---|---|---|---|
| DE | 380265 | C * | 9/1923 | E04H 17/003 |
| ES | 2054553 | A2 * | 8/1994 | E04H 17/003 |
| GB | 2073799 | A * | 10/1981 | E04H 17/003 |

OTHER PUBLICATIONS

Razor wire fence photo.
Rota-Spike—Security Topping, webpage available on the world wide web at http://www.jacksons-fencing.co.uk/security-fencing/security-toppings/rotaspike/security-toppings-rotaspike.aspx.
Rotating anti climb spikes, still shot from video available on the world wide web at http://www.youtube.com/watch?v=Mw1jr21x4qc.
Security Fencing with Rotating Spikes, webpage available at http://www.mortimerfabs.co.uk/industrial/UKM9JX2.

* cited by examiner

*Primary Examiner* — Josh Skroupa
(74) *Attorney, Agent, or Firm* — Mark D. Miller; William K. Nelson

(57) ABSTRACT

Improved devices, systems and methods for deterring intruders. The deterrent devices and systems may be attached to an upper portion of a vertical barrier or other structure. Embodiments of the invention include panels of a rigid material having a plurality of malleable elongate extensions capable of being configured into various arrangements, a panel support member for suspending the panels adjacent to a barrier, and system supports for attachment to the barrier and for supporting the panel support member. The panels are capable of rotating around the panel support member.

29 Claims, 8 Drawing Sheets

CONFIGURABLE ROTARY SECURITY PANEL BARRIER

FIELD OF THE INVENTION

The present invention relates to security barriers for preventing access to intruders and more particularly to improved security barriers having one or more configurable rotary security panels, which may be rotatably mounted on a structure to prevent an intruder from passing over or through the structure, and related methods of use.

DISCUSSION OF THE BACKGROUND

There are several existing devices designed to prevent trespassers from intruding upon property, including static devices such as barbed wire, razor wire, and spikes. Such devices are typically positioned at the top of a fence, wall or other barrier to provide added deterrence to a would-be intruder. Such devices can be effective at deterring would-be intruders, but they also suffer from drawbacks.

Static security devices can be overcome, if the intruder is sufficiently determined to do so; and static devices also pose a risk of grave injury to those would-be intruders who attempt to traverse them. Causing serious injury to would-be intruders is not particularly desirable, as such deterrent devices may create liability for the owner of the property and it may be unnecessary to cause such injury in order to deter such a would-be intruder. It may also be undesirable to cause serious injury to the would-be intruder, as he or she may not pose any significant threat to the property. For example, teenagers getting into mischief (e.g., sneaking into a private golf course) may be seriously injured trying to overcome barbed wire on a perimeter fence. It is preferable to have barrier system that is more effective, and less dangerous than existing static devices discussed above.

It is therefore desirable to provide a configurable non-static security device for preventing access to property that is both effective and less dangerous than existing static security barriers. The present invention provides such apparatuses, and related methods of use, while avoiding the problems described above.

SUMMARY OF THE INVENTION

The present invention provides improved barrier systems and methods for preventing access to property by would-be intruders or trespassers. A preferred embodiment of the present invention includes a configurable rotary security panel barrier that may include an axial support member (e.g., a wire, cable, pipe, pole, or rod) having one or more freely rotatable panel members positioned along the axial support member. The rotatable panel members may each have a central axial receiver (e.g., one or more tabs having holes therein, a cylindrical center member, etc.) through which the axial support member passes such that the rotatable panel members are able to rotate around the axial support member. The rotatable panel members may each have elongate extensions that are rigid, but also malleable, such that they can be configured into a desired arrangement for preventing traversal of the barrier. For example and without limitation, the elongate extensions may be configured into a radiating pattern (e.g. a radiating spiral).

Embodiments of the panels of the present invention may be made from a metal having sufficient malleability to allow elongate extensions on such a panel to be manipulated using commonly available tools, such as vice and pliers. However, the elongate extensions may also be sufficiently rigid to prevent would-be intruders from manipulating the elongate extensions when the panels are installed as a barrier, for example, at or near the top of a wall or fence. In some embodiments, the elongate extensions may be in the form of tines having a tapering profile. Such tines may be sharpened or unsharpened depending on a desired level of deterrence for the barrier.

In some aspects, the present invention relates to an improved deterrent device, the device comprising a panel of rigid, malleable material having a plurality of elongate extensions thereon capable of being configured into various arrangements, and a central channel for receiving a panel support member (which may be horizontal and may run along the top portion of a vertical barrier, such a fence or wall), where the panel is capable of rotating around the horizontal panel support member. The panel may have a central axial portion from which the elongate extensions (e.g., tines) laterally or radially extend. The central axial portion may have a circular central channel for receiving the panel support member. In other implementations, and without limitation, the central axial portion may have one or more tabs having holes therein for receiving a horizontal panel support member, rather than a central channel. In other implementations, and without limitation, the central axial portion may have an open channel (e.g., a semi-circular channel) having one or more tabs having holes therein for receiving the horizontal panel support member. Exemplary panels of the present invention may include other structures in addition to the elongate extensions that extend out from the central axial portion. As an example, and without limitation, the panels may have a combination of elongate extensions and broad plate structures extending from the central axial portion.

The deterrent devices of the present invention may be installed on the panel support member horizontally at or near the top of a vertical barrier (e.g., a fence or wall), vertically on a structure (e.g., on a vertical pole supporting an antenna or other item that may need protection from tampering or theft), horizontally on the panel support member near the ground as a stand-alone deterrent, and in other positions and configurations.

In some embodiments, the invention relates to improved devices for deterring intruders that may be attached to an upper portion of a vertical barrier (e.g., a wall or fence), comprising one or more panels of rigid material having a plurality of malleable elongate extensions (e.g., tines) capable of being configured into various arrangements, and an axial support receiver (e.g., a closed central channel, one or more tabs having a hole therein for receiving a panel support member, etc.), at least one panel support member (e.g., a wire, cable, pole, rod, pipe, etc.) for suspending the one or more of the panels, where the one or more panels are rotatably installed on the panel support member(s), and one or more anchoring devices for receiving the panel support member(s), where the anchoring devices are configured to be affixed to the vertical barrier. Such an anchoring device may include (1) an anchor portion capable of being attached to the top of a fence post or drilled into a wall, to thereby install and stabilize the anchoring device, and (2) a receiving portion having one or more joints or receiver structures for receiving an end of a panel support member. The anchoring devices may function to suspend the panel support member(s) above the vertical barrier, and thereby allow the panel support member(s) to suspend the panel(s) at or near a top of the vertical barrier. The one or more panels may be held in position relative to one another on the panel support member by, for example, inter-panel collars that are installed on the panel support member between adjacent panels. Such inter-panel collars may serve to maintain spacing between the panels and reduce friction between the panels and the panel support member. In other implementations, and without limitation, the panels may include interlocking portions that connect adjacent panels directly to each other, thereby forming a single rotating unit.

In some embodiments, the present invention relates to systems for preventing traversal of a vertical barrier, comprising a support system for attachment to the vertical barrier, the support system comprising at least one panel support member, and at least one anchoring device having (1) an anchoring portion for attaching the support system to the vertical barrier, and (2) a receiving portion having at least one connector for engaging the at least one panel support member; and a plurality of rigid panels, each having a plurality of malleable elongate extensions capable of being manipulated into various arrangements and at least one support receiver for receiving the at least one panel support member of the support system.

In some embodiments, the present invention relates to devices for deterring intruders for attachment to an upper portion of a vertical barrier that includes a continuous patterned sheet of rigid material having a central axial section, a plurality of malleable elongate extensions capable of being configured into various arrangements, and a plurality of suspension hangers; a panel support member for suspending the continuous patterned sheet, wherein the plurality of suspension hangers are configured to be rotatably coupled to the panel support member; and at least one support bracket for receiving an end of the panel support member, the anchoring device configured to be connected to the vertical barrier. In such embodiments, the barrier may be formed from one piece of material (e.g., a ribbon of patterned metal) that can be cut to a desired length depending on the length of the wall, fence, or other barrier upon which the barrier will be installed.

In some embodiments, the present invention relates to a system for preventing traversal of a wall or fence, comprising a support system for attachment to the vertical barrier, the support system having one or more anchoring devices, at least one panel support members, and a plurality of rigid panels, each having a plurality of malleable elongate extensions capable of being manipulated into various arrangements and one or more support receivers for receiving the at least one panel support member of the support system. In some implementations, and without limitation, such systems may include a second plurality of rigid panels installed on a separate panel support member, and in proximity to the first plurality of rigid panels. The second plurality of rigid panels may make it more difficult to traverse the barrier than a single plurality (or row) of rigid panels, providing additional deterrence to a would-be intruder. In further implementations, and without limitation, more than two pluralities (or rows) of rigid panels may be provided (e.g., the system may include 3-10 pluralities or rows of rigid panels).

In some embodiments, the present invention relates to methods of establishing a barrier to intruders, comprising bending rigid, malleable elongate extensions of a rigid panel into a preferred pattern, threading a panel support member through an axial support receiver running through an axial central portion of such a rigid panel, where the panel is configured to rotate around the panel support member when contacted, and installing the horizontal panel support member on or near an upper portion of a wall or fence.

In some embodiments, the present invention relate to methods of establishing a barrier to intruders, comprising laying out a desired length of barrier from a roll (or continuous sheet) of patterned metal barrier; cutting the patterned metal barrier to length; bending rigid, malleable elongate extensions of the metal barrier into a preferred pattern (or twisting the metal barrier into a spiral pattern to create a spiral radiating pattern of the extensions), threading a horizontal barrier support member (which are similar to the panel support members of other embodiments disclosed herein) through a plurality of suspension hangers (e.g., tabs) attached to an axial central portion of the metal barrier, where the metal barrier is configured to rotate around the horizontal barrier support member when contacted, and installing the horizontal barrier support member on or near an upper portion of a barrier (e.g., a fence or wall).

It is therefore an object of the present invention to provide deterrent systems that are simple to erect, or to install on a fence, wall, or other barrier.

It is a further object of the present invention to provide deterrent systems that have tailorable security features (tines) that can be adapted to the particular structure on which the system will be installed and the particular security level needed.

It is a further objection of the present invention to provide modular security barriers that can be applied successfully to structures (e.g., fences or walls) of various lengths and heights.

It is a further objection of the present invention to provide security barriers formed from a single, continuous sheet of material that can be applied successfully to structures (e.g., fences or walls) of various lengths and heights.

It is also an object of the present invention to provide an effective deterrent to would-be intruders that does not constitute a trap that might otherwise cause substantial harm to unauthorized intruders. The barrier may prevent children or other non-threatening persons from climbing a barrier and trespassing on a protected property.

Additional objects of the invention will be apparent from the detailed descriptions and the claims herein.

DETAILED DESCRIPTION

Figure 1:
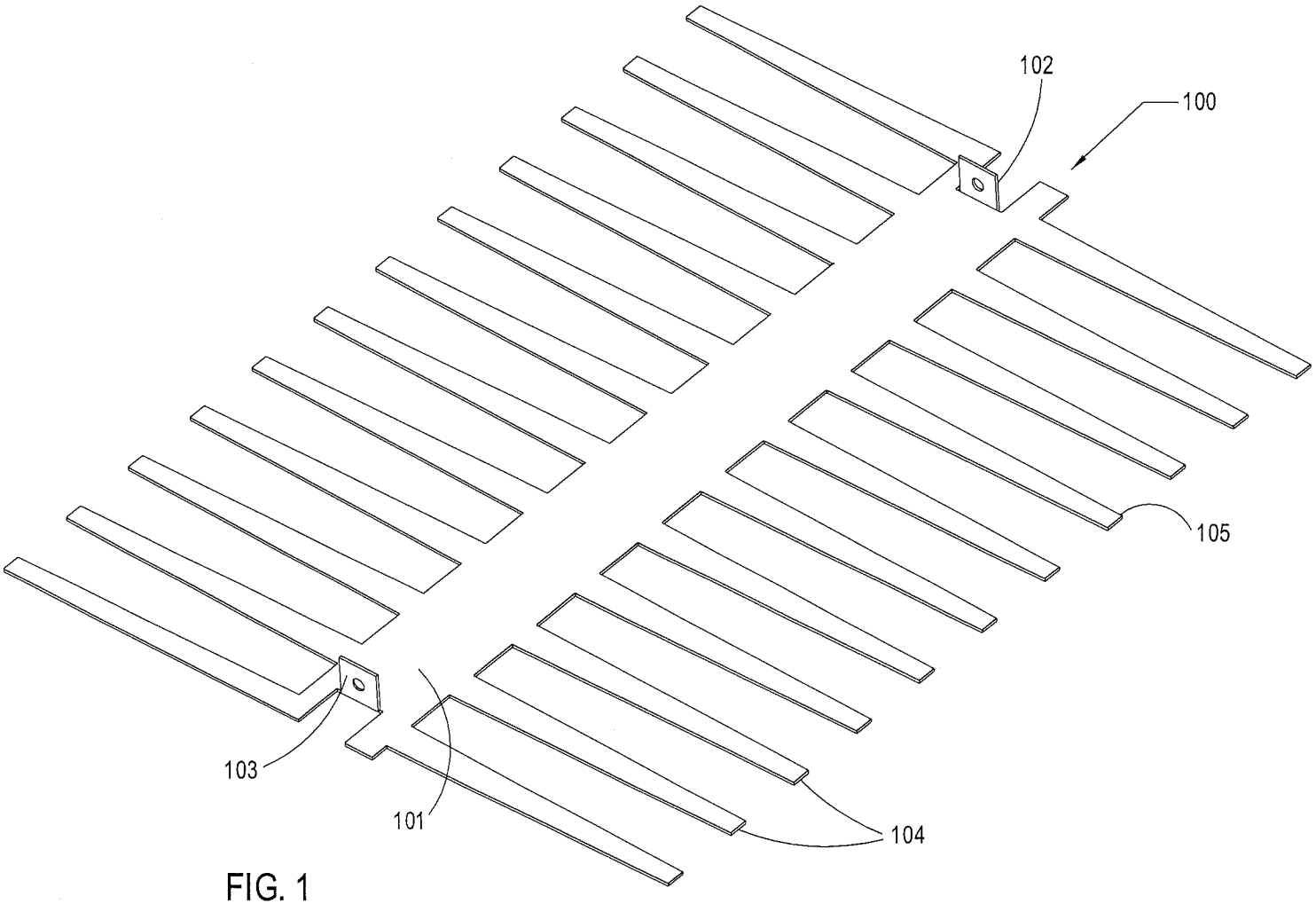
FIG. 1 is a perspective view of an embodiment of the security panel of the present invention.

Referring to the drawings wherein like reference characters designate like or corresponding parts throughout the several views, and referring particularly to FIGS. 1-8, it is seen that the illustrated embodiments of the invention a drawn to deterrent systems for preventing potential intruders from traversing a barrier (e.g., a vertical barrier such as a wall or fence). The deterrent systems include panels having elongate extensions (e.g., tines) that can be configured according to the preferences of the user. Multiple panels may be arranged on a panel support member (e.g., a wire, cable, pole, rod, pole, or other device capable of supporting the panels) for suspending the panels to create a row or series of movable panels adjacent to each other to create a barrier. The deterrent systems may have additional anchoring devices to which the panel support member may be connected. The deterrent systems of the present invention may include one or more rows or series of panels, where the rows or series are adjacent to each other and may create a continuous barrier. Embodiments of the invention also include methods of establishing a barrier that includes a deterrent system as described herein.

It is to be understood that the drawings are not to scale and that the size of certain features may be exaggerated in relation to the other features of the depicted aspect or part of invention. It is also to be understood that the drawings are for illustrative purposes, and, while they provide support for the description of the invention, they do not limit the scope of the invention.

FIG. 1 shows an example panel according to one embodiment of the present invention. The panel 100 has a central body 101 having tines 104 extending from both lateral sides thereof. The tines are elongate and may optionally taper along their lengths. The panel may also include tabs 102 and 103 at the ends of the body 101. The tabs 102 and 103 may each have a central hole therein (102*a* and 103*a*, respectively) and be designed to receive a panel support member (e.g., a wire, cable, pole, rod, pipe, or other device capable of suspending one or more of the panels) through the hole, allowing the panels to be rotatably suspended and function as a barrier or part of a barrier. In some implementations, the holes 102*a* and 103*a* may be lined with a friction reducing material to allow the panel 100 to spin freely around a panel support member. For example, and without limitation, a grommet or bearing composed of a friction-reducing plastic (e.g., various polytetrafluoroethylene [PTFE] plastics) or other low-friction material may be installed in holes 102*a* and 103*a*. In other implementations, the panels may have a closed central channel running axially along the central body 101, through which a panel support member may be passed. In other implementations, and without limitation, the panels may have an open channel (e.g., a semi-circular channel) having tabs embedded therein, where the tabs have aligned holes through which the panel support member may be received.

In some embodiments, tines 104 may be capable of being configured or manipulated into desired configurations. For example, the panel 100 may be made from a malleable or semi-malleable metal that will allow a user of the panels to manipulate and arrange the tines 104 into a desired configuration for use as a barrier. For example, the panel 100 may be stamped from sheet steel (e.g., cold rolled steel) having a thickness that allows the tines to be bent using appropriate tools such as a vice and pliers, but the sheet steel may be of a sufficient thickness and rigidity to prevent a would-be intruder from being able to manipulate the shape and arrangement of the panels when they are installed on the panel support members of the present invention. The panels may also be made from other metallic materials such as stainless steel, aluminum, various alloys, etc. Other suitable materials are also contemplated within the scope of the present invention.

In some implementations, and without limitation, the tines 104 may have edges that are flat and/or dull to avoid serious injury to would-be intruders. In such implementations, the panels may be used to form a less dangerous barrier than conventional barbed wire, razor wire, or the like. However, in alternative embodiments, and without limitation, the tines 104 may have a sharp edge along all or a portion of its perimeter 105 to increase the effectiveness of the panel 100 as a deterrent. For example, the distal tips of the tines may have a sharp edge; or both sides of the tines may have sharp edges.

Figure 2:
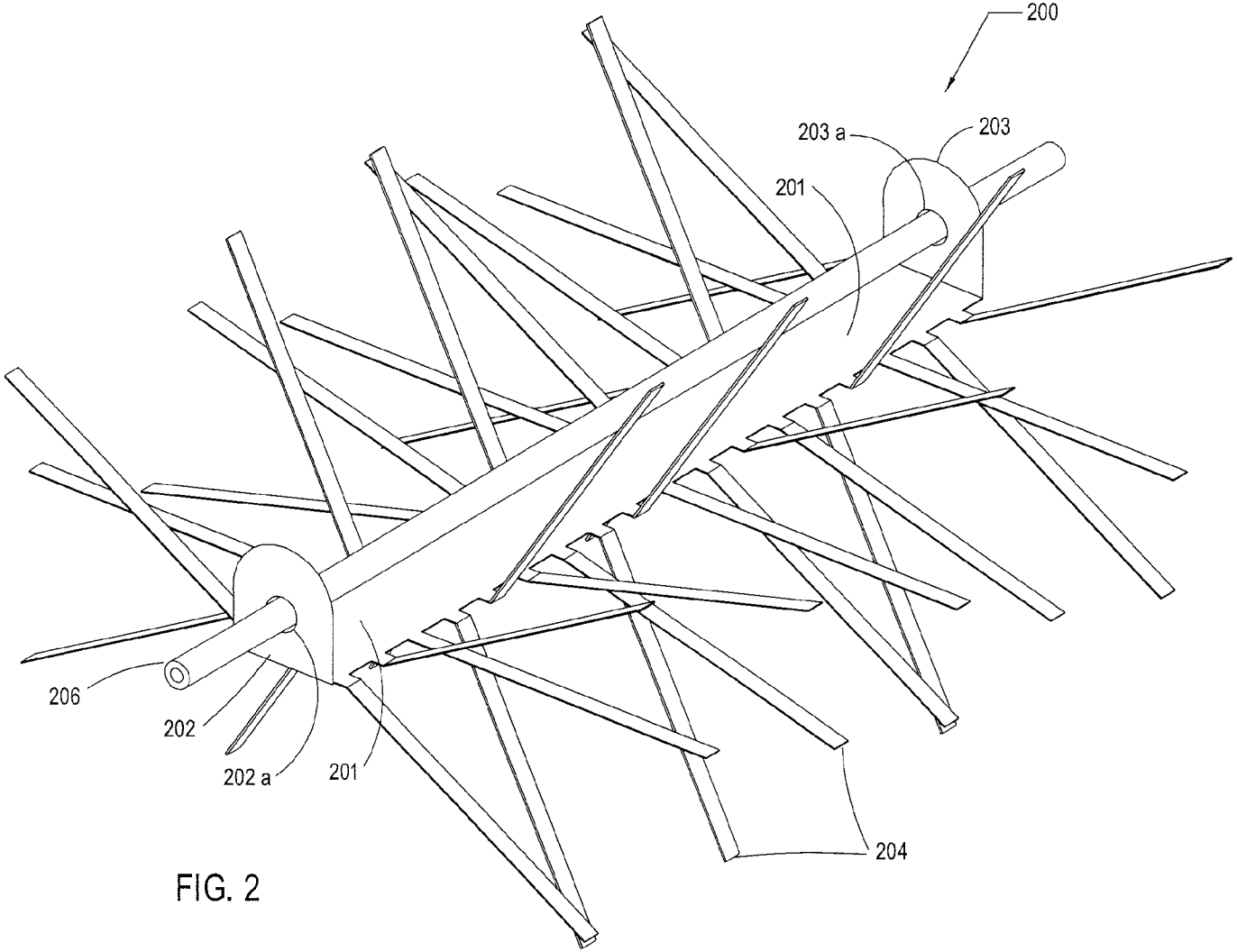
FIG. 2 is a perspective view of another embodiment of the security panel of the present invention.

As an example, and without limitation, FIG. 2 shows a panel 200 having tines 204 that are arranged in a radiating pattern. The tines 204 radiate at various angles from the body 201 in a range from 0° to about 180° from each side of the body 201. FIG. 2 represents one manner in which a user of panels of the present invention may manipulate the arrangement of the tines. When the panel 200 is mounted on the panel support member 206 (e.g., a vertical or horizontal support wire, cable, bar, pole, rod, pipe, or other device capable of supporting the panels), the panel 201 can rotate on the panel support member 206 with tines projected in virtually all directions, thereby preventing a would-be intruder from bypassing the panel 200.

The exemplary embodiment of FIG. 2 also demonstrates how tabs such as 202 and 203 may engage with the panel support member 206. The illustrated panel support member 206 is threaded through holes 202*a* and 203*a* located near the center of tabs 202 and 203, respectively, to allow the panel 200 to freely rotate around the panel support member 206. The tabs 202 and 203 may be formed substantially parallel to one another and substantially perpendicular to the body 201. This arrangement of the tabs allows the panel support member 206 to be substantially parallel to the adjacent surface of the body 201 and to be substantially aligned with the midline of the body 201. The holes 202*a* and 203*a* may be formed at a consistent, centered position in the tabs 202 and 203 to facilitate alignment of the holes and a consistent position of the panel support member 206 when it is received through the holes 202*a* and 203*a*. In other embodiment, and without limitation, the panels may each have a closed, axial channel running down the length of the body for receiving the panel support member. In further embodiments, and without limitation, the panels may each have an open channel (e.g., a semi-circular channel) having one or more tabs having holes therein for receiving the horizontal panel support member.

Figure 3:
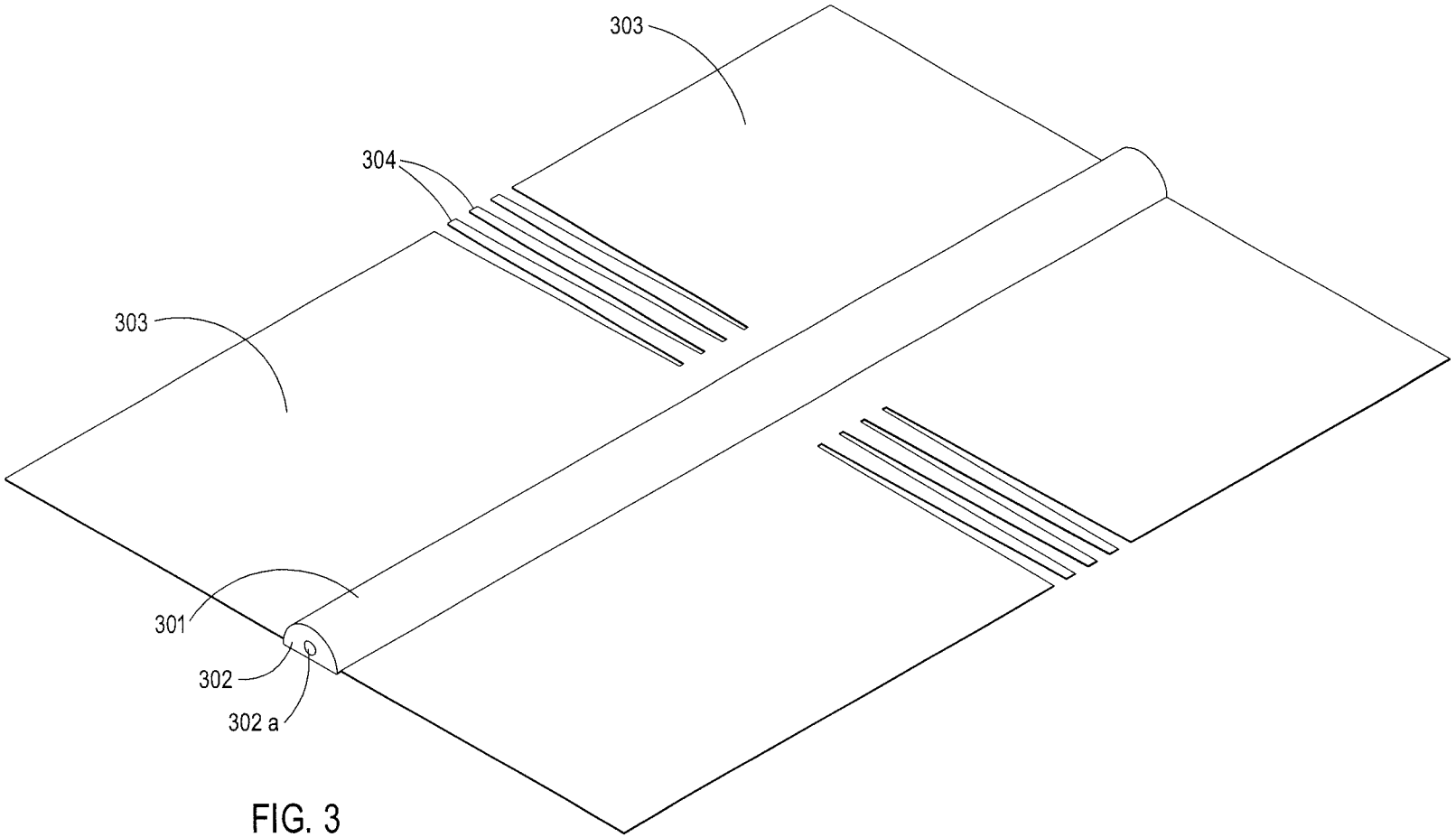
FIG. 3 is a perspective view of another embodiment of the security panel of the present invention.

FIG. 3 shows an alternative example of a panel of a deterrent system of the present invention. Illustrated panel 300 includes a central channel 301, tines 304 that extend from either side of a central channel 301, and flat plates 303 that extend from either side of the central channel 301. The central channel 301 may have tabs 302 located at each end thereof. In other implementations additional tabs may be located along the central channel 301. Each of the tabs 302 may have a hole 302*a* therein for receiving a panel support member that may be positioned along the central channel 301.

In the exemplary embodiment of FIG. 3, the flat plates 303 and the tines 304 may be co-planar when the panels are in their original manufactured condition. However, the panels 300 may be formed from a malleable or semi-malleable material, such that the tines 304 and plates 304 may be bent and configured to the user's preferences. Additionally, the present invention is not limited to the rectangular plates depicted in FIG. 3. The panels of the present invention may have plates of various shapes, including rectangular, semi-circular, semi-elliptical, triangular, polygonal, and various other shapes. In some implementations, and without limitation, the panels of the present invention may also have plates having additional features along their edges, such as serrations, elongate extensions (e.g., tines), teeth, blades, etc. The present invention is also not limited to the particular arrangement of tines and plates shown in FIG. 3. The panels of the present invention may have various arrangements of plates and tines. In some embodiments, and without limitation, panels may have solely plates as deterrent features, without the presence of tines.

Additionally, the panels of the present invention may include plates that may have a sharpened edge along all or a portion of a perimeter thereof.

It is to be understood that the panels of the present invention may include other deterrent features in addition to the plates and elongate extensions described herein. The deterrent features described in the present application are intended as illustrative examples, and are not intended to limit the scope of the invention.

In some embodiments, the deterrent systems of the present invention may comprise a set of panels (e.g., like the panels of FIG. 1) installed side-by-side on a panel support member. The panel support member may be a wire, cable, bar, pole, rod, pipe, or other elongate device capable of supporting the panels. The deterrent systems may further include a set of anchoring devices (e.g., support brackets) that receive the ends of the panel support members and suspend the panel support member and panels (e.g., horizontally). The adjacent panels may be provided with a small amount of space therebetween (e.g., about a quarter of an inch or less) to allow free rotation of adjacent panels on the panel support member, while preventing access between panels. In other implementations, the systems may include low-friction spacers that engage with the tab holes or channel openings of adjacent panels (e.g., holes 102*a* and 103*a*) of adjacent panels (e.g., a spacer having collars on either side that fit into the tab holes or channel openings of the adjacent panels), allowing the adjacent panels to spin freely relative to one another while holding the panels at consistent spacing. The spacers may include intrinsic clamps, fasteners, or other means for fixing their positions on the panel support member, allowing them to prevent shifting of the panels on the panel support member that may otherwise occur over time due to wind and other environmental factors, or that may otherwise occur due to tampering.

Figure 4:
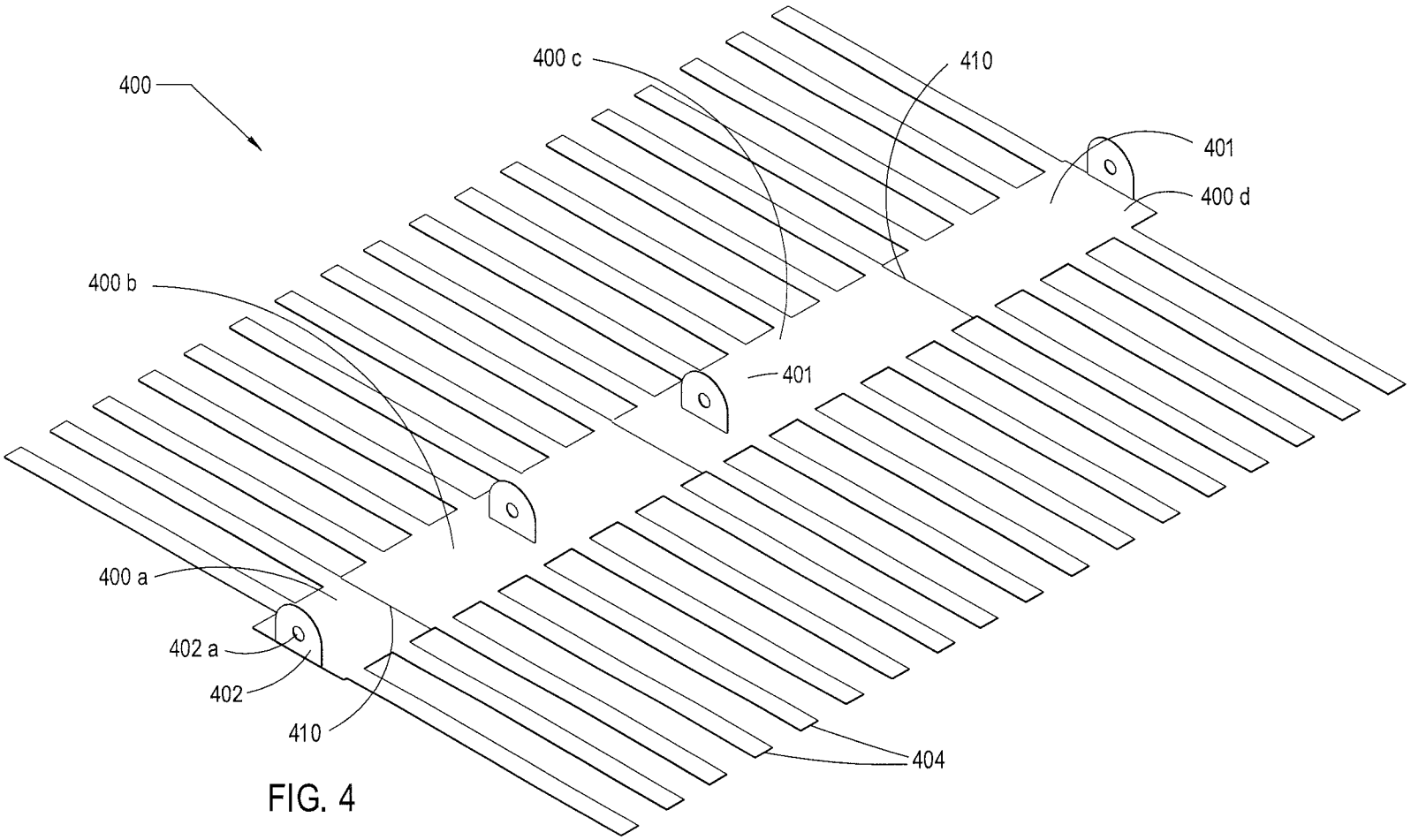
FIG. 4 is a perspective view of a modular panel embodiment of the security panel of the present invention.

In alternative embodiments of the deterrent system, the panels of the system may be capable of interlocking into an interlocked set of modular panels. In such embodiments, the deterrent system can easily accommodate various lengths of fences, walls, or other structures by adding modular panels of various widths. FIG. 4 shows a set of modular panels 400, having individual panels 400*a*, 400*b*, 400*c*, and 400*d* that are interlocked at joints 410. Each modular panel has a central body 401 and bendable tines 404 extending laterally from body 401, and at least one tab 402 for receiving a panel support member through hole 402*a*. In other implementations, and without limitation, the modular panels of the present invention may have an axial channel or other structure for receiving a panel support member.

The exemplary joints 410 allowing the panels to interlock may have various interlocking mechanisms. In some implementations, each panel may have interlocking surfaces or brackets (e.g., having holes punched therein for receiving bolts, pins, etc.) that are perpendicular to the surface of the body 401, and the interlocking surfaces of the adjacent panels can be bolted together. For example, the adjacent panels 400*b* and 400*c* may each have an interlocking surface on each end thereof that is perpendicular to its body 401, and that interface with one another so that they can be affixed to each other with bolts, screws, pins, or other attaching means. In such implementations, the interlocking surfaces or brackets may also include a hole for receiving the panel support member, and thus eliminate the need for additional tabs on the panel. In other implementations, each modular panel may have interlocking surfaces that are coplanar and continuous with the body 401, and that are designed to overlap with an interlocking surface of an adjacent panel. The overlapped panels may have holes that align, allowing the panels to be affixed to each other with bolts, pins, rivets, etc. In further implementations, each modular panel may have an enlarged area along one edge (e.g., a cylindrical enlargement at one interlocking edge of the panel) and a slot that is complementary to the enlarged edge, such that adjacent panels can be slotted together and interlocked prior to receiving the horizontal panel support member. It is to be understood that the scope of the present invention includes additional mechanisms and structures for interlocking the modular panels of the present invention, and the examples provided herein are exemplary and are not intended to limit the scope of the invention.

Modular panels may allow the user to install the deterrent systems of the present invention on structures of various heights or lengths. For example, a modular panel embodiment can be installed at or near the top of a length of wall or fence, and the modular panels may be installed along the entire length of the wall or fence. The user can add the number of panels necessary to the length of wall or fence to extend along the entire length. In some embodiments, the modular panels may have consistent sizing (e.g., each panel may have a width in a range of 4 to 12 inches). In other implementations, the modular panels may have varying sizes (e.g., in a range of 4 to 24 inches), which may better allow the user to accommodate various lengths of wall or fence. The modular panel system may also include end panels (e.g., panels 400*a* and 400*d* as shown in FIG. 4) having tabs 402 at one end thereof, instead of an interlocking surface. The tabs of the end units may receive the panel support member and provide needed support at the ends of an assembled modular interlocking panel system.

As in other embodiments of the present invention, the panels 400 may be made from a malleable or semi-malleable material, and the tines 404 may be configured to the preferences of the user using common tools such as a vice and pliers. Each of the tines 404 may have a flat and/or dull edge to provide a barrier system that is less dangerous than conventional barrier devices such as barbed wire, razor wire, etc. In alternative embodiments, the tines may have a sharp edge around its perimeter or a portion thereof. Also, as in other embodiments of the present invention, the modular panels may have various deterrent features, including combinations of tines and plates having various shapes and features.

Figure 5:
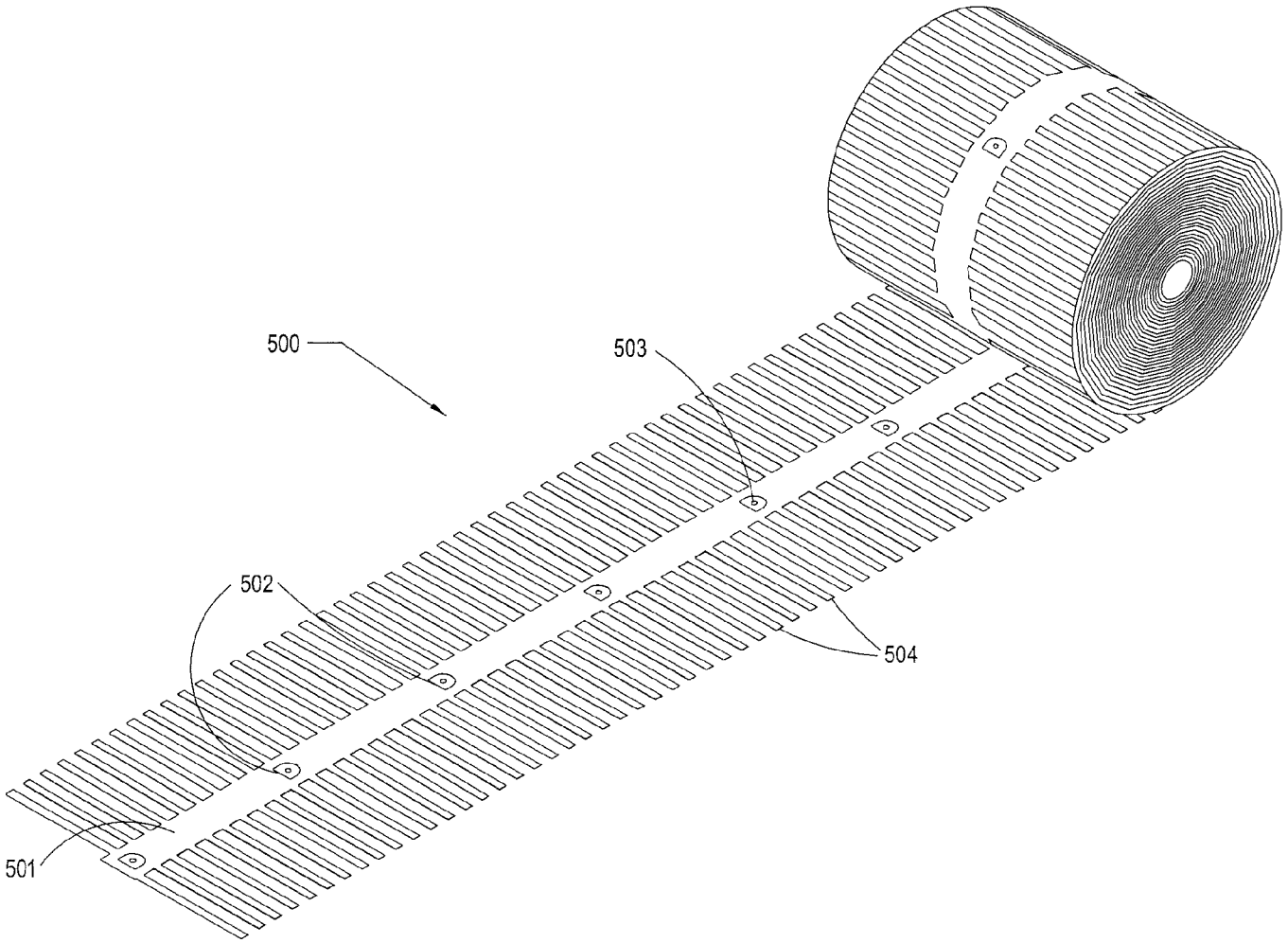
FIG. 5 is a perspective view of a continuous ribbon barrier embodiment of the present invention

In still further embodiments of the deterrent system, rather than individual panels, the barrier may be a continuous metal "ribbon" having tines laterally projecting therefrom. The ribbon barrier of such embodiments can be transported and stored in rolls, and a length of barrier can be can easily sized to accommodate various lengths of fences, walls, or other structures by simply cutting the ribbon to a desired length with an appropriate tool (e.g., metal shears). FIG. 5 shows a roll 500 of barrier ribbon, partially unrolled. The ribbon may include a central body 501 having tabs 502 for receiving a panel support member. The ribbon may also include tines 504 that laterally project from a central section 502. As in other embodiments of the present invention, the ribbon may be made from a malleable or semi-malleable material, and the tines 504 may be configured to the preferences of the user using common tools such as a vice and pliers. The tabs 502 may likewise be bent and manipulated to be in alignment with one another to facilitate coupling of the ribbon to a panel support member as described herein. Each of the tines 504 may have a flat and/or dull edge to prevent serious injury to a person or animal that attempts to traverse the barrier. In alternative embodiments, the tines of the ribbon may have a sharp edge around their perimeters or a portion thereof.

The embodiment of FIG. 5 may include additional parts, such as end tabs (not shown) that can be added to the one or more ends of the ribbon that are cut when the ribbon is sized for a particular length of fence, wall, etc. The end tabs may generally be about the same size and shape as the illustrated tabs 502, and may be attached to the central body by various attachment means, such as bolts, welding, soldering, etc. The embodiment of FIG. 5 may also include grommets composed of a friction-reducing plastic (e.g., various polytetrafluoroethylene [PTFE] plastics), or bearings, or other low-friction material placed in the holes 503 of tabs 502. It is to be understood that the scope of the present invention includes additional embodiments of a barrier structure and that the exemplary embodiments described herein are provided as an illustration and are not intended to limit the scope of the invention.

The deterrent systems of the present invention may be installed at or near the top of a vertical barrier (e.g., a fence or wall), thereby preventing a would-be intruder from climbing or traversing the vertical barrier. However, the deterrent systems are not limited to such implementations, and may be installed and utilized in different arrangements. For example, the deterrent systems may be installed in a vertical orientation (e.g., where the panel support members run vertically). For example, an exemplary deterrent system may be installed on or around a vertical pole to prevent unauthorized persons or animals from climbing the pole. In other implementations, the deterrent systems may be installed horizontally along the ground, for example, to prevent the intrusion of terrestrial animals.

The deterrent systems of the present invention may include a number of components (e.g., a kit) that can be used to install the deterrent systems on various structures, or as a freestanding barrier. The deterrent systems may include a plurality of panels (e.g., individual panels 100 as shown in FIG. 1, modular panels 400 as shown in FIG. 4, etc.), one or more panel support members (e.g., one or more cables, wires, poles, bars, rods, pipes, or other elongate devices capable of supporting the weight of the panels), two or more anchoring devices for receiving and supporting the panel support members, which may include at least two anchoring devices for attaching the anchoring devices to a vertical barrier (e.g., a wall or fence) or other structure, and two or more system supports (e.g., poles) that can be installed in the ground in cases where the barrier system is used as a stand-alone barrier.

Exemplary anchoring devices may be provided in the form of a heavy, rigid bar or plate having one or more means for receiving an end of a panel support member. Such anchoring devices may also have a means for attachment to a fence, wall, or other structure. For example, such anchoring devices may have an adaptor device for attachment to a fence or wall. In some implementations, and without limitation, the adaptor device may include two extensions or plates designed to (1) flank opposite sides of a fence post or pole and (2) be attached to the post or pole by screws, bolts, pins, or other fixation devices. In other implementations, the adaptor device may be a bracket designed for attachment to a vertical or horizontal surface of a wall. It is to be understood that the anchoring devices disclosed herein are exemplary and are not intended to limit the scope of the present invention. Additional anchoring device designs are included within scope of the present invention.

Exemplary anchoring devices may also have a joint structure (e.g., a slot or other receiving structure) for receiving an end of a panel support member. Such a joint structure may be made to withstand a large amount of applied force, since the panel support member may have a large number of panels thereon. Such anchoring devices may also have multiple joint structures for supporting multiple panel support members. For example, and without limitation, the anchoring devices may be configured to receive panel support members that are positioned above two lengths of a fence or wall that meet where the anchoring device is attached to the fence or wall (e.g., at a fence post or corner). As a further example, and without limitation, the anchoring device may be configured to receive panel support members that are positioned parallel and adjacent to each other to support two rows of panels that run along the same length of a fence or wall. In some implementations, the position of the joint structure may be adjustable to accommodate various positions of the deterrent system on a barrier structure. For example, the user may wish to position the anchoring device on a corner of a barrier structure (e.g., a 90° corner of a fence), with panels running along the two sections of the barrier that meet at the corner. In such instances, the joint structures on the anchoring device may also be at 90° relative to one another in order to able to connect with the panel support members running along the two lengths of the barrier that meet at the corner. In such implementations, the joint structures may be on adjustable sleeves that can be rotated or otherwise adjusted on the anchoring device (e.g., sleeves in a complimentary cylindrical recess on the anchoring device, allowing the adjustable sleeve to rotate, but not move up and down along the anchoring device). In further implementations, in addition to the position of the joint structures being adjustable along the circumference or perimeter of the anchoring device, the joint structures themselves can be rotated or adjusted (e.g., it can be rotated on the surface of the adjustable sleeve) to accommodate an installation of the anchoring device at an orthogonal or oblique angle relative to the barrier.

In some embodiments, and without limitation, the anchoring devices may have an adjustable height to allow the system to be adapted to a number of different fence or wall structures. For example, the anchoring devices may include adjustable brackets for attachment to poles or other support structures of a wall, fence, or other barrier structure, where the brackets have extendable joints (e.g., slidable, lockable joints) that allow the separation between the tines of the panels and the top of the fence to be adjusted.

Figure 6:
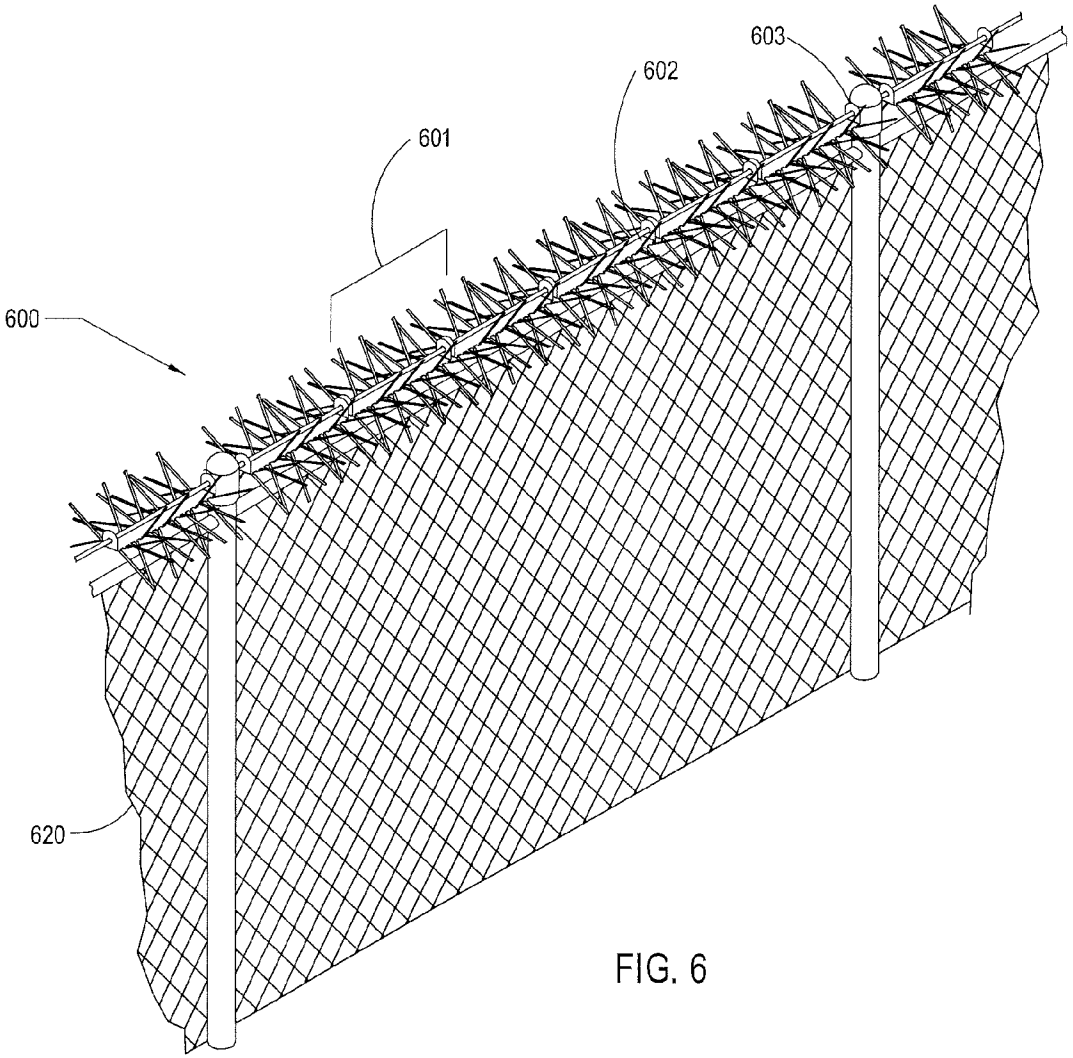
FIG. 6 is a perspective view of embodiments of security panels of the present invention installed at the top of a fence.

FIG. 6 shows an exemplary deterrent system 600 installed at the top of a fence 620. The deterrent system 600 includes panels 601 having radiating tines, a horizontal panel support member 602, and anchoring devices 603 connected to vertical poles of the fence 620 and engaged with and supporting the panel support members 602. The anchoring devices 603 in the example system of FIG. 6 may each be a heavy, rigid sleeve (e.g., a metal sleeve) that can be placed around the vertical poles, with lockable slot joints (e.g., a lockable flange for receiving a rigid collar on the end of the panel support member). In this illustrated embodiment (and similarly in other embodiments, the anchoring devices (e.g., 603) may create just enough separation between the tines of panels (e.g., panels 601) and the upper portion of the barrier (e.g., fence 620) to allow the panels to rotate without contacting the upper portion of the barrier.

In other implementations, the deterrent systems may include modular panels that can be installed above the vertical barrier (e.g., a fence as shown in FIG. 6). For example, interlocked panels may be installed on a panel support member suspended between anchoring devices, which are installed on a fence. The interlocked panels may span an entire section of the fence between two posts of the fence, providing a continuous connected barrier.

Figure 7:
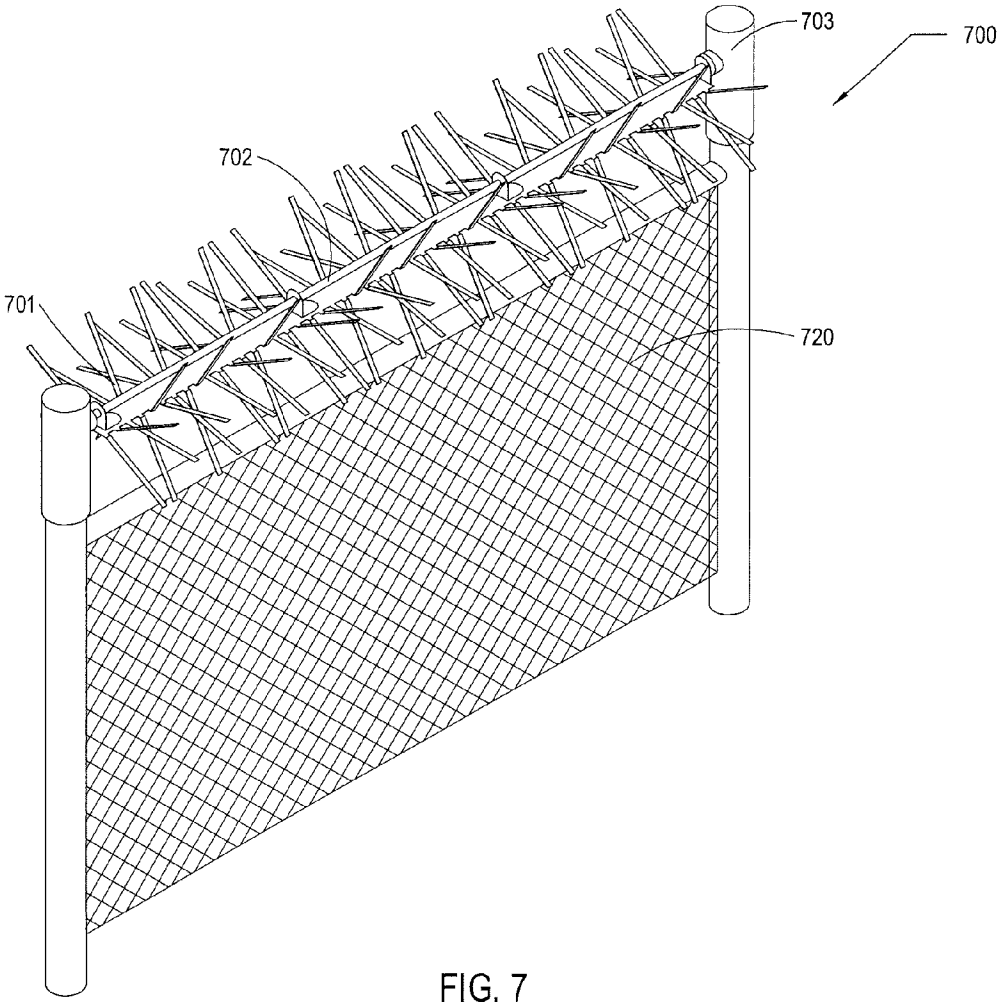
FIG. 7 is a perspective view of a continuous ribbon barrier embodiment of the present invention installed at the top of a fence.

In further embodiments, the ribbon barrier shown in FIG. 5 may be installed above a vertical or other structure. FIG. 7 shows an exemplary deterrent system 700 installed at the top of a fence 720. The illustrated deterrent system 700 includes ribbon barrier 701 having radiating tines, a horizontal ribbon support member 702 threaded through the pop-up tabs of the ribbon barrier 701, and anchoring devices 703 connected to vertical poles of the fence 720 and engaged with and supporting the ribbon support member 702. The illustrated anchoring devices 703 may each be a heavy, rigid sleeve (e.g., a metal sleeve) that can be placed around the vertical poles, with lockable slot joints (e.g., a lockable flange for receiving a rigid collar on the end of the panel support member). In such embodiments, the central body of the ribbon may be optionally twisted into a spiral pattern to create radiating spiral arrangement of the tines. Twisting the central body of the ribbon may be done instead of manipulating the each tine to extend from the central body at a particular angle.

Figure 8:
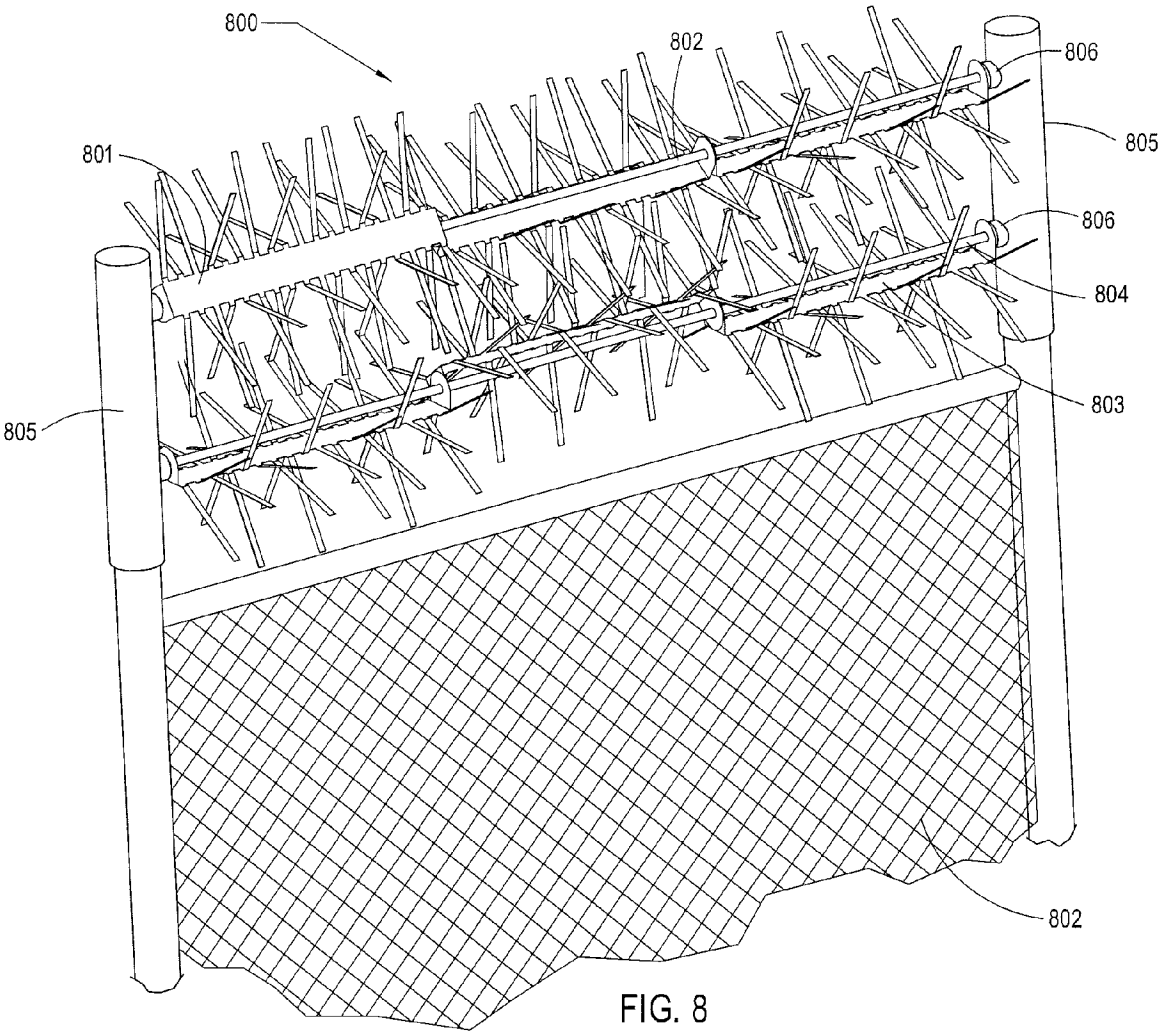
FIG. 8 is a perspective view of embodiments of modular security panels of the present invention installed at the top of a fence.

FIG. 8 shows another exemplary deterrent system 800 having a first plurality of panels 801 installed on a first horizontal panel support member 802 and a second plurality of panels 803 on a second horizontal panel support member 804 located below the first plurality of panels 801. The first horizontal panel support member 802 and the second horizontal panel support member 804 illustrated in FIG. 8 may be connected to vertical anchoring devices 805. The illustrated anchoring devices 805 may create a small amount of separation (e.g., without limitation, about 0.5 inches to about 2 inches of separation) between the tines of the second plurality of panels 803 and the upper portion of the fence 820 to allow the panels to rotate without contacting the upper portion of the fence 820. The anchoring devices may also create a small amount of separation between the first plurality of panels 801 and the second plurality of panels 803 to allow the first and second plurality of panels to rotate past one another. In some implementations, the anchoring devices may have an adjustable height to allow the system to be adapted to a number of different fence or wall structures. For example, the anchoring devices may have extendable joints (e.g., slidable, lockable joints) that allow the separation between the tines of the panels and the top of the fence to be adjusted.

In some embodiments, where two or more rows of panels are installed together as a barrier (e.g., at the top of a fence or wall, or at ground level), the panels may be arranged closely together such that (1) the tines of in one row of panels are staggered with respect to a second row of panels located adjacently thereto (e.g., above or below), and (2) the tines of the first row of panels pass through gaps between the tines on the second row of panels, and vice versa. This interdigitated positioning of the tines provides an even tighter barrier with little space in between rows of panels. In some implementations, and without limitation, the rows of panels may be as close to each other as possible. For example, and without limitation, the panels may be arranged such that there is a gap of about an inch or less between the tines of the panels of the first row and the body of the panels in the second row. In such implementations, and without limitation, the tines of each panel may be configured in an alternating pattern such that one is bent into a position that is, e.g., about 70° to about 100° relative to the adjacent tines on the panel. Such an arrangement of the tines prevents large gaps between the tines and between the rows of panels. The arrangement of panels discussed above can be implemented with the stand-alone panels (e.g., panels as exemplified in FIGS. 1 and 2), interlocking panels (e.g., the panels as exemplified in FIG. 4), the ribbon barrier (e.g., the barrier as exemplified in FIG. 5), and other embodiment of the barrier panels. It is to be appreciated that arrangements of panels and tines discussed above are exemplary and do not limit the present invention, and that other arrangements of the tines and panels are encompassed by the present invention.

Other embodiments of the deterrent system are contemplated within the scope of the present invention. For example, and without limitation, the system may include three or more pluralities of panels (or three or more ribbon barriers) that are arranged side-by-side (or top-to-bottom) to create a barrier of several adjacent sets of panels. In such embodiments, the anchoring devices may each have three or more joint structures for receiving the panel support members of the three or more pluralities of panels. In such embodiments, the deterrent system may be installed on an existing barrier (e.g., a fence or wall) or the deterrent system may be installed at ground level creating a stand-alone barrier.

Embodiments of the present invention may also have additional features. For example, and without limitation, all or some of the components of the deterrent system (e.g., all the components, the panels and panel support members, or other combinations of components) may be conductively connected to each other, allowing the deterrent system or portions thereof to be electrified. Without limiting the invention, in such embodiments a non-lethal amount of voltage may be applied to conductively connected components of the fence in order to deter would-be intruders without causing serious injury.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A device for deterring intruders for attachment to an upper portion of a vertical barrier comprising:

a. at least one panel of semi-rigid material having:

i. a plurality of malleable elongate extensions thereon, wherein said plurality of elongate extensions are positioned side by side along an axial length of said at least one panel and each of said elongate extensions is individually capable of being configured into a radiating position at various angles relative to the other elongate extensions, and ii. an axial support receiver thereon, b. a panel support member for engaging said axial support receiver and rotatably suspending said at least one panel; and c. at least anchoring device for receiving an end of said panel support member, wherein said anchoring device is operable to connect to said vertical barrier.

2. The device of claim 1, further comprising an interlocking member for interlocking said at least one panel to a second panel.

3. The device of claim 1, wherein said at least one panel comprises a central axial portion, and said plurality malleable of elongate extensions extend outwardly from the central axial portion.

4. The device of claim 3, wherein said plurality of malleable elongate extensions comprises a first group of malleable elongate extensions that extend from a first side of said central axial portion, and a second group of malleable elongate extensions that extend from a second side of said central axial portion.

5. The device of claim 3, wherein said axial support receiver is located on said central axial portion of said panel.

6. The device of claim 3, wherein said axial support receiver comprises at least two tabs located on said central axial portion of said panel.

7. The device of claim 1, wherein said malleable elongate extensions have dull edges.

8. The device of claim 1, wherein said vertical barrier is a wall or fence.

9. The device of claim 1, wherein said panel support member is selected from the group consisting of a cable, a wire, a pipe, a rod, and a pole.

10. A system for preventing traversal of a vertical barrier, comprising:

a. a support system for attachment to said vertical barrier, said support system comprising:
   i. at least one panel support member, and
   ii. at least one anchoring device having (1) an anchoring portion for attaching said support system to said vertical barrier, and (2) a receiving portion having at least one connector for engaging said at least one panel support member; and b. a plurality of semi-rigid panels, each having:
   i. a plurality of malleable elongate extensions that are positioned side by side along an axial length of the panel and each of said malleable elongate extensions is individually capable of being manipulated into a radiating position at various angles relative to the other elongate extensions, and
   ii. at least one axial support receiver for receiving said at least one panel support member of said support system.

11. The system of claim 10, wherein each of said plurality of rigid panels comprises at least one interlocking member for interlocking with an adjacent panel.

12. The system of claim 10, wherein each of said plurality of rigid panels comprises a central axial portion, and said plurality malleable of elongate extensions extend outwardly from the central axial portion.

13. The system of claim 12, wherein said plurality of malleable elongate extensions comprises a first group of malleable elongate extensions that extend from a first side of said central axial portion, and a second group of malleable elongate extensions that extend from a second side of said central axial portion.

14. The system of claim 10, wherein said at least one panel support member comprises a first panel support member and a second panel support member.

15. The system of claim 14, wherein said plurality of rigid panels are arranged in two adjacent rows of said rigid panels, a first row engaged with said first panel support member and a second row engaged with said second panel support member.

16. The system of claim 15, wherein said rigid panels of said first row are interlocked with each other, and said rigid panels of said second row are interlocked with each other.

17. The system of claim 15, wherein said malleable elongate extensions of said panels in said first row are staggered with respect to said malleable elongate extensions of said rigid panels in said second row such that said malleable elongate extensions of said rigid panels in said first row can move past said elongate extensions of said rigid panels in said second row without contact between said malleable elongate extensions of said first row and said second row.

18. The system of claim 10, wherein said at least one support receiver is on said central axial portion of said panel.

19. The system of claim 18, wherein each of said plurality of rigid panels comprises at least two support receivers on said central axial portion of said panel.

20. The system of claim 10, wherein said malleable elongate extensions have dull edges.

21. The system of claim 10, wherein said vertical barrier is a wall or fence.

22. The system of claim 10, wherein said at least one panel support member is selected from the group consisting of a cable, a wire, a pipe, a rod, and a pole.

23. A method of establishing a barrier to intruders, comprising:

a. configuring semi-rigid, malleable elongate extensions of a semi-rigid panel into a preferred pattern, wherein said elongate extensions are positioned side by side along an axial length of said at least one panel and each of said elongate extensions is individually capable of being manipulated into a radiating position at various angles relative to the other elongate extensions;

b. threading a panel support member through at least one axial support receiver of said semi-rigid panel, wherein said semi-rigid panel is configured to rotate around said panel support member; and c. installing said panel support member near an edge of said barrier.

24. The method of claim 23, further comprising installing a second panel support member near said edge of said barrier, and threading said second support member through support receivers of a second rigid panel.

25. The method of claim 24, wherein the elongate extensions of said rigid panel are staggered with regard to the elongate extensions of said second rigid panel.

26. The method of claim 25, wherein the first and second panel support members are installed in proximity to one another such that elongate extensions of said rigid panel interdigitate with the elongate extensions of said second rigid panel, and the staggered arrangement allows said elongate extensions of said rigid panel to rotate past said elongate extensions of said second rigid panel without contact between said rigid panel and said second rigid panel.

27. A device for deterring intruders for attachment to an upper portion of a barrier, comprising:

a. a continuous roll of patterned of semi-rigid sheet material operable to be unrolled to a desired length of flattened sheet material and cut to said desired length, said semi-rigid sheet material having:
   i. a central axial section,
   ii. a plurality of malleable elongate extensions that are positioned side by side along an axial length of said at least one panel and each of said elongate extensions is individually capable of being configured into a radiating position at various angles relative to the other elongate extensions, and
   iii. a plurality of suspension hangers, b. a panel support member for suspending said continuous patterned sheet, wherein said plurality of suspension hangers are configured to be rotatably coupled to said panel support member; and c. at least one anchoring device for receiving an end of said panel support member, said anchoring device configured to be connected to said barrier.

28. The device of claim 27, wherein said plurality of malleable elongate extensions comprises a first group of malleable elongate extensions that extend from a first side of said central axial section, and a second group of malleable elongate extensions that extend from a second side of said central axial section.

29. The device of claim 27, wherein said malleable elongate extensions have dull edges.

* * * * *